United States Patent [19]

Todd

[11] 3,956,100

[45] May 11, 1976

[54] CREOSOTE AND A METHOD FOR PRODUCING THE SAME

[75] Inventor: Donald V. Todd, Murrysville, Pa.

[73] Assignee: Koppers Company, Inc., Pittsburgh, Pa.

[22] Filed: Mar. 31, 1975

[21] Appl. No.: 563,639

[52] U.S. Cl. ..... 208/2
[51] Int. Cl.[2] ..... C07C 37/00
[58] Field of Search ..... 208/2

[56] References Cited

UNITED STATES PATENTS

| | | | |
|---|---|---|---|
| 2,291,295 | 7/1942 | Harvey | 208/2 |
| 2,291,296 | 7/1942 | Harvey | 208/2 |
| 2,291,298 | 7/1942 | Harvey | 208/2 |
| 2,291,300 | 7/1942 | Harvey | 208/2 |
| 2,291,315 | 7/1942 | Harvey | 208/2 |
| 2,291,330 | 7/1942 | Harvey | 208/2 |

FOREIGN PATENTS OR APPLICATIONS

| | | | |
|---|---|---|---|
| 230,681 | 3/1925 | United Kingdom | 208/2 |

OTHER PUBLICATIONS

Chem. Ab. 72, 4431*a*, 1970.

*Primary Examiner*—Veronica O'Keefe
*Attorney, Agent, or Firm*—Herbert J. Zeh, Jr.; Oscar B. Brumback; Kenneth J. Stachel

[57] ABSTRACT

An improved creosote wood preservative is produced that has a reduced crystal content, a light color and that makes a creosote-pentachlorophenol preservative less corrosive to metals. This improved creosote is produced by mildly hydrogenating a conventional coal tar creosote to reduce the aromaticity index, $I_A$, by 10–62%. This is accomplished by hydrogenating the creosote at a temperature in the range of 250°–450°C. in the presence of a sulfur resistant hydrogenation catalyst.

15 Claims, No Drawings

CREOSOTE AND A METHOD FOR PRODUCING THE SAME

BACKGROUND OF THE INVENTION

This invention relates to an improved creosote wood preservative and a process for making the same by hydrogenating a conventional coal tar creosote.

Creosote has been used to preserve wood from decay and biological attack for many years. Creosote consists of liquid and solid aromatic hydrocarbons. Creosote is obtained from the high temperature carbonization of bituminous coal as a distillate boiling in the 200°–400°C. range. Although creosote is an excellent wood preservative, it has several problems. One problem is that creosote has a dark color which is imparted to wood treated with creosote. Another problem is that crystals form in the creosote when it is not kept hot. This crystal formation is a problem when creosote is transported or stored. Whenever a car or tank of creosote cools, crystals form and settle out and it is difficult to get all the settled crystals back into solution by reheating the creosote.

Creosote may also be used with pentachlorophenol as a wood preservative. Pentachlorophenol in a 5% solution with petroleum is not corrosive to metal equipment used in the wood-treating process. Creosote when used alone as a wood preservative is only slightly corrosive to the metal equipment used in the wood-treating process. However, when creosote and pentachlorophenol are used in a mixture, the ordinary steel or iron equipment used in the treating process is subjected to an intensive corrosion action. The prior art tries to overcome the problem of a corrosive pentachlorophenol, hereinafter referred to as penta, in creosote admixture by adding corrosion inhibitors. Not all corrosion inhibitors are effective on a penta in creosote admixture and those that are effective have a high cost.

The hydrogenation of hydrocarbon oils such as petroleum oils, coal extract and creosote is old in the art. The art has hydrogenated these hydrocarbon oils for many reasons and many of these reasons involved the lowering of the aromatic content of the hydrocarbon oils. Creosote has been hydrogenated in the past under severe conditions to produce motor fuel and jet fuel. A high temperature coal tar creosote has been hydrogenated to increase the toxicity of the high temperature creosote. Also, a wood preserving creosote complying with American Wood-Preservers' Association (A.W.-P.A.) specifications has been hydrogenated at less than severe conditions to produce a beneficiated creosote. These conditions include a temperature of 395°C., but generally a temperature above 300°C., and a pressure of 225 atmospheres and 14,000 ft.$^3$ of hydrogen per barrel of creosote and a reaction time of 45 minutes and the presence of a molybdenum sulfide and aluminum chloride catalyst. The beneficiated creosote has a toxic value in excess of the original creosote. The temperature, pressure, time and hydrogen flow are coordinated so as not to induce the formation of a substantial percentage of nontoxic constituents as for instance chain structures, that would preclude enhanced toxic induction. Apparently, in this method of hydrogenation, any reduction of aromatic content of the creosote is to be avoided. Illustrative of the prior art pertinent to such hydrogenation of creosote are the following: U.S. Pat. No. 2,291,295 (Harvey), U.S. Pat. No. 2,291,330 (Harvey), and an article in Gas Eng 52, 15-17 (1935) by J. G. King.

SUMMARY OF THE INVENTION

In accordance with this invention an improved creosote wood preservative is produced from a conventional coal tar creosote which is corrected, uncorrected, or a distillation fraction of a conventional coal tar creosote. The improved creosote is as toxic as a conventional creosote wood preservative but has a reduced crystal content and a lighter color and reduces the corrosivity of a penta in creosote mixture wherein the improved creosote is used as the creosote. The process for producing the improved creosote involves subjecting the conventional creosote or creosote distillation fraction to a mild hydrogenation that reduces the aromaticity index of the creosote 10–62%. The aromaticity index, $I_A$, is a ratio of aromatic C-H bonds to aliphatic C-H bonds as determined by infrared spectroscopy.

The mild hydrogenation is conducted at a temperature in the range of 250°–450°C. in the presence of a sulfur resistant hydrogenation catalyst. The catalyst must be a catalyst that promotes hydrogenation and is not poisoned by the sulfur compounds in the creosote. Examples of such a catalyst are: tungsten sulfide, molybdenum sulfide or a cobalt sulfide or a mixture of two or more of these compounds with or without a support. The support used may be a carbonaceous support like activated carbon, coke, or charcoal or an oxide support like silica, alumina or magnesium. The hydrogen pressure and reaction time may be varied. If the hydrogen pressure is a low pressure, then the reaction time is longer and if the pressure is a high pressure, then the reaction time is less. Hydrogen gas is used to hydrogenate the creosote or creosote distillation fraction. The hydrogen consumption varies for different creosotes. The hydrogen consumption for an uncorrected coal tar creosote is around 5.7 pounds of hydrogen per 1000 pounds of creosote. The hydrogen consumption of corrected creosote is around 80% of that for the uncorrected creosote.

In order to keep any crystals in solution that may be formed in the improved or hydrogenated creosote at low temperatures, a correction oil may be added. The correction oil may be added to the creosote before mild hydrogenation or to the improved creosote after the mild hydrogenation. The quantity of correction oil needed will be less than that needed for a conventional coal tar creosote. The correction oil is a low boiling solvent mixture of methylnaphthalenes and a solvent that is compatible with both the methylnaphthalenes and creosote. Correction oil may also be added to a coal tar creosote to adjust its contents to meet the A.W.P.A. Grade I Standard, PI-65. This correction oil may be somewhat corrosive to metals. Therefore, it is best to add a corrosive correction oil to the coal tar creosote before the creosote is subjected to mild hydrogenation. In this manner, the corrosive correction oil is also mildly hydrogenated to reduce its corrosivity to metals.

The quantity of penta added to the improved creosote to make a penta in creosote preservative that has a reduced corrosivity to metals may be any quantity desired in the final penta in creosote preservative. The final product may be made comparable to the A.W.-P.A. standard P11-70. In this case, a minimum of 2% penta is added to the improved creosote to yield a 2% penta in creosote wood preservative. The penta is usually added to the improved creosote when the latter is hot. When penta is added to the improved creosote, any correction oil that is added to the improved creosote must be added before the penta is added to the improved creosote.

The aromaticity index, $I_A$, may be determined by infrared spectroscopy by determining the absorbence or the transmittance at 3.3 microns (aromatic C-H) and at 3.4 microns (aliphatic C-H). The $I_A$ is used to indicate the relative amounts of aromatic and aliphatic hydrocarbons present in a sample containing creosote. The $I_A$ is equal to aromatic C-H/aliphatic C-H. A method for determining the aromaticity index is described by M. B. Dell, "Characterization of Pitches for Carbon Anodes", Fuel 38, 183–187 (1959).

DETAILED DESCRIPTION OF THE INVENTION

In the process of this invention any corrected or uncorrected conventional coal tar creosote or distillation fraction thereof may be subjected to mild hydrogenation. Any one of the following A.W.P.A. standard creosotes may be used: PI-65, P7-72, P13-65. These standard creosotes are also cited in the United States Federal Standards as TT-C-645B and TT-C-655(1). Also, any distillation fraction of these standard creosotes may be subjected to the mild hydrogenation. Usually, the fraction used is the highest boiling fraction or the fraction containing most of the phenanthrene, anthracene and carbozole, hereinafter referred to as PACs. If the creosote is corrected, this means that a correction oil is added to the creosote to keep the PACs in solution or to upgrade the creosote to meet A.W.P.A. standards.

In the batch operation of the process of this invention the conventional coal tar creosote used is preferably a corrected A.W.P.A. grade PI-65. This creosote is charged to a reaction vessel that contains a sulfur resistant hydrogenation catalyst. This catalyst is preferably a sulfided Aero HDS-2 which is 14.5-16% molybdenum sulfide and 3–4% cobalt sulfide on alumina. The Aero HDS-2 comprising 14.5-16% molybdenum oxide and 3–4% cobalt oxide is manufactured by American Cyanamid Company. This Aero HDS-2 catalyst is sulfided by any method known to those skilled in the art. This sulfiding refers to the substitution of a sulfide ion, $S^{-2}$, for the oxide ion in the Aero HDS-2 catalyst.

The reaction vessel is pressurized with hydrogen to any pressure less than the hydrogen pressure from the hydrogen source but preferably in a range of 500 to 1500 psig. The reaction vessel is heated to a temperature in the range of 250°–450°C. but preferably a temperature in the range of 250°–330°C. The reaction vessel is held at these conditions for a reaction time preferably in the range of 0.5 to 6.0 hours. Under these mild hydrogenation conditions a creosote is produced that has a reduced aromaticity index of 10–62% from the aromaticity index of the original conventional coal tar creosote. Preferably, the aromaticity index is reduced to a value in the range of 1.3–1.7.

In the continuous operation of the process of this invention any creosote or distillation fraction of creosote may be used but the A.W.P.A. standard PI-65 creosote is preferred. It is also preferred to use a corrected A.W.P.A. PI-65 creosote. Therefore, a quantity of correction oil familiar to those skilled in the art is added to the PI-65 creosote. This corrected creosote is heated preferably by heat exchange with reactor effluent. This heated corrected creosote is mildly hydrogenated in any standard reactor but preferably a trickle bed reactor is used. The trickle bed contains a sulfur resistant hydrogenation catalyst which is preferably a sulfided American Cyanamid Aero HDS-2A comprising 3–4% cobalt sulfide and 14.5–16.0% molybdenum sulfide on an alumina base. This catalyst has a good catalyst life and may be regenerated periodically.

The reactor is pressurized to a pressure in a range of 500-1500 psig and preferably in the range of 600-850 psig. The hydrogen gas supplied to the reactor may be produced by any method known to those skilled in the art. The hydrogen supplied to the reactor may consist of fresh make-up hydrogen and recycled hydrogen from the reactor. A good ratio of recycle to make-up hydrogen is around 3 to 1. The reactor is heated to a temperature in the range of 250°-450°C. but preferably in the range of 290–330°C. when the pressure is in the range of 600–850 psig. Generally, if you increase the pressure you can decrease the temperature. The feed rate of creosote expressed in weight hourly space velocity, WHSV, as pounds of creosote per hour per pound of catalyst is not critical but should be in a general range of 1.0 to 5.0 and preferably in a range of 2.0 to 3.6. Under these conditions a mildly or partially hydrogenated corrected creosote is produced as the improved creosote.

This improved creosote is withdrawn from the trickle bed reactor as a reactor effluent. This effluent is cooled and the improved creosote is separated from the recycle gas, preferably in a high pressure separator. At this point the improved creosote may contain dissolved gases which may be partially removed by letting the pressure down to essentially atmospheric in a low pressure separator and further reduced by open-steam stripping in a packed column at atmospheric pressure.

The improved creosote produced has a reduced aromaticity index of 10–62% from that of the original coal tar creosote and the $I_A$ is preferably in a range of 1.3–1.7. When the original creosote has an $I_A$ of 2.6, the preferred reduction in $I_A$ is 35–50% to obtain an $I_A$ value in the range of 1.3–1.7.

The improved creosote produced either by the batch operation or by the continuous operation has a lighter color and reduced crystal content from that of the conventional creosote. The color of the improved creosote has a Cleveland Electric Illuminating Company (C.E.I.) Color Number of 6. This C.E.I. color number refers to color standards set in Ser. No. 073 in 1965 by the Cleveland Electric Illuminating Company for the color of creosoted wood utility poles. The color standard has values from 1 to 9 ranging from a light color to a black color. Also the improved creosote reduces corrosion to metal when used as the creosote in a penta in creosote wood preservative. However, the improved creosote retains the same toxicity for the protection of wood as that of a conventional coal tar creosote.

To make a penta in creosote preservative that has a reduced corrosivity to metals, penta is added to the improved creosote. Any method of addition known to those skilled in the art may be used. Preferably the penta is dissolved in the improved creosote. Any quantity of penta may be used. Preferably the improved penta in creosote preservative is comparable to the A.W.P.A. standard P11-70. Therefore, a minimum of 2% penta is dissolved in the improved creosote. The penta is preferably dissolved in the improved creosote when the improved creosote is hot. Any penta can be used but it is preferred to use penta that conforms to A.W.P.A. standard P8-74.

When the process of this invention is used to reduce the corrosivity of a penta in creosote preservative, any correction oil that is corrosive should be added to the creosote before it is subjected to mild hydrogenation. The correction oil may be added to the creosote to adjust its composition to meet A.W.P.A. grade I standards or to help keep the PACs in solution. An example of a corrosive correction oil that is added to creosote to adjust its composition is naphthalene still residue. A typical naphthalene still residue may contain the following compounds: naphthalene, monomethylnaphthalenes, diphenyl, dimethylnaphthalenes, acenaphthene, flourene, dibenzofuran, methylflourene, phenanthrene and/or anthracene, carbazole, fluoranthene and pyrene. If the corrosive correction oil is not added to the creosote before mild hydrogenation, any penta in creosote preservative produced from an improved creosote containing the corrosive correction oil would still be corrosive. By adding the corrosive correction oil to the creosote before mild hydrogenation the corrosivity of the correction oil can be reduced.

It is believed, but the process of this invention is not limited by this belief, that mild hydrogenation of creosote to reduce the aromaticity index 10–62% converts some of the aromatic ring compounds in creosote to compounds having fewer aromatic rings, alicyclic compounds and aliphatic compounds. The compounds in creosote responsible for crystal formation at low temperature are the PACs. Upon mild hydrogenation of the creosote the PACs become compounds with fewer aromatic rings. This loss of aromaticity and gain of hydrogen in the PACs cause these compounds to crystalize at lower temperatures than the PACs in conventional creosote. Some of the aromatic compounds that lose their aromaticity upon mild hydrogenation contain nitrogen and sulfur. These compounds form alicyclic bases and aliphatic bases and ammonia. These basic compounds neutralize any free chlorine or hydrochloric acid in the penta when penta is dissolved in the improved creosote. The hydrochloric acid may be formed as a hydrolysis product when penta comes in contact with water that may be present in the creosote. These free chlorines and hydrochloric acid are believed to be responsible for the conventional penta in creosote preservative being corrosive to metals. The hydrogenation of the creosote must be mild or partial so that the aromaticity index is not decreased more than 62%. If the hydrogenation was more severe, i.e., aromaticity index decreased greater than 62%, some of the aromatic compounds responsible for the toxicity of creosote would lose their aromatic character. Such a loss would render the creosote less toxic and the creosote would be ineffective as a preservative for wood. If penta was added to an ineffective creosote, the only preservative value would be that of the penta.

It is also believed, without limiting the process of this invention, that any corrosion in a penta-in-improved creosote preservative to which a corrosive correction oil such as naphthalene still residue has been added after mild hydrogenation is caused by the correction oil. A correction oil like naphthalene still residue may contain free chlorine compounds and acidic organic compounds. Any free chlorine in the naphthalene still residue would be neutralized by the improved creosote like the free chlorine and hydrochloric acid in the penta. The organic corrosion, i.e., the corrosion due to acidic organic compounds must be overcome by hydrogenation. Therefore, any correction oil that is organically corrosive and that is to be added to the improved creosote must be added to the original coal tar creosote before hydrogenation. In this manner, the acidic organic compounds may be chemically reduced by the mild hydrogenation of the original coal tar creosote. Any non-corrosive correction oil may be added to the creosote either before or after mild hydrogenation.

For a better understanding of the invention, reference should be had to the following tables and descriptions of experimental runs. Table I and Table II present data from a batch operation to produce the improved creosote. The coal tar creosote used was an uncorrected A.W.P.A. grade I creosote. Table III presents data from two continuous runs. Table IV presents comparison data on the reduction of corrosion and crystals in creosote, corrected creosote and hydrogenated creosote. Table V presents data on the toxicity of the improved creosote.

In runs 1–3 of Table I, one kg. of the grade I creosote having an $I_4$ of 1.52 was charged to a one gallon stainless steel stirred autoclave. One hundred grams of the given catalyst was also charged to this autoclave. The autoclave was pressured and repressured with hydrogen as required and at the end of the run the autoclave was cooled, vented, discharged and the catalyst filtered.

In runs 4-8 of Table I, the uncorrected A.W.P.A. grade I creosote charged to the autoclave had an $I_4$ of 2.61. The 100 grams of used sulfided Aero HDS-2 catalyst charged to the autoclave was reused in each run. The autoclave was pressured to 300 psig with hydrogen at ambient temperature, then heated to the given reaction temperature and pressured to 800 psig and repressured as required. At the end of the run the autoclave was cooled, vented, discharged, and the product filtered.

Table I

Mild Hydrogenation of Creosote

| Run No. | Catalyst | Pressure psig | Reaction Temp.,°C. | Reaction Time,hrs. | Product, $I_4$[a] | Reduction of Original $I_4$,% |
|---|---|---|---|---|---|---|
| 1 | $MoS_3$ | 500 | 170 | 0.25 | 1.13 | 26 |
| 2 | $MoS_3$[b] | 800 | 50–190 | 5.0 | 0.57 | 62 |
| | | 700 | 190–285 | 2.5 | | |
| | | 550 | 285–350 | 4.5 | | |
| | | 800 | 285–300 | 5.0 | | |
| | | | Total | 12.0 | | |
| 3 | HDS-2[c] | 800[d] | 300 | 12.5 | 0.57 | 62 |
| 4 | HDS-2[e] | 800[d] | 300 | 6.0 | 0.94 | 64 |
| 5 | HDS-2[e] | 800[d] | 300 | 2.5 | 1.39 | 47 |
| 6 | HDS-2[e] | 800[d] | 300 | 0.5 | 1.71 | 34 |
| 7 | HDS-2[e] | 800[d] | 275 | 0.5 | 2.03 | 22 |

Table I-continued

| Run No. | Catalyst | Pressure psig | Reaction Temp.,°C. | Reaction Time,hrs. | Product, $I_4$[a] | Reduction of Original $I_4$,% |
|---|---|---|---|---|---|---|
| | | Mild Hydrogenation of Creosote | | | | |
| 8 | HDS-2[e] | 800[d] | 250 | 0.5 | 2.17 | 17 |

[a]$I_4$ = aromaticity index calculated from the ratio of IR absorbance at 3.3 microns (aromatic) to that at 3.4 microns (aliphatic).
[b]Recovered from preceding run No. 1.
[c]American Cyanamid - Aero HDS-2 catalyst (15% molybdenum sulfide and 3% cobalt sulfide on alumina).

[d]Pressured at room temperature to 300 psig. with hydrogen, then to 800 psig. at reaction temperature.
[e]Used sulfided Aero HDS-2 catalyst from previous run.

In Table II each of the nine runs was made in an identical manner. The autoclave was charged with one kg. of uncorrected A.W.P.A. grade I creosote and 100 gm. of sulfided Aero HDS-2 catalyst. The autoclave was pressured to 300 psig with hydrogen, then heated to 300°C., repressured to 800 psig and held at 300°C. for 1 hour. Then, the autoclave was cooled. The autoclave was pressured with hydrogen from a gas holder at room temperature. After the autoclave was cooled, the gas was vented through a gas meter. The off-gas volume was subtracted from the hydrogen gas volume used from the gas holder to arrive at a hydrogen consumption.

Table II

| Run No. | HDS-2 Catalyst | Off-gas, cu.ft. | (moles) | Product,$I_4$ | Corrected Hydrogen Usage, moles | Remarks |
|---|---|---|---|---|---|---|
| | | Nine Identical Runs - Mild Hydrogenation of Creosote | | | | |
| 9 | Fresh | 2.05 | (2.6) | 1.69, 1.63[a] | 2.9 | — |
| 10 | Used | 1.58 | (2.0) | 1.54 | 3.3 | Briefly above 330°C. |
| 11 | Fresh | 1.66 | (2.1) | 1.61 | 3.0 | — |
| 12 | Used | 1.75 | (2.2) | 1.70 | 2.9 | — |
| 13 | Fresh | 1.81 | (2.3) | | 2.5 | — |
| 14 | Used | 1.72 | (2.2) | Composited | 3.0 | — |
| 15 | Used | 1.94 | (2.5) | 1.68 | 2.3 | — |
| 16 | Used | [0.35 | (0.8) | | 3.8] | Probable: leaky autoclave |
| 17 | Used | 1.47 | (1.9) | 1.76 | 2.8 | |

[a]Duplicate analyses.

In Table III the data presented from two continuous runs on the mild hydrogenation of creosote are in average values. The average values were determined from values obtained periodically during the continuous run.

Table III

| Run No. | Feed | Original $I_4$ | Max T° °C. | WHSV[a][b] | Aromaticity Index, $I_4$ | Reduction of Original $I_4$,% | Pressure psi |
|---|---|---|---|---|---|---|---|
| | | Average Values for the Mild Hydrogenation of Creosote in Two Continuous Runs | | | | | |
| 1 | Corrected creosote | 1.7–1.75 Avg 1.72 | 309 | 2.46 | 1.08 | 37 | 800 |
| 2 | Uncorrected creosote | 2.6 | 314 | 2.9 | 1.49 | 43 | 790 |

[a]The catalyst used was a sulfided Aero HDS-2 catalyst and the amount of catalyst charged to the reactor was 2.959 lbs.
[b]Lbs. Product/Hr./Lb. of Catalyst.

In the continuous runs the creosotes used had the following characteristics:

| Creosote in run no. 1: a corrected creosote | | Creosote in run no. 2: uncorrected creosote | |
|---|---|---|---|
| specific gravity | 1.086 | specific gravity | 1.118 |
| distillation: The distillate obtained in percent by weight on a water-free basis within the following limits: | | | |
| up to 210°C. | 0.8 | up to 210°C. | 0.0 |
| up to 235°C. | 4.6 | up to 235°C. | 0.0 |
| up to 270°C. | 22.9 | up to 270°C. | 4.7 |
| up to 315°C. | 53.0 | up to 315°C. | 27.7 |
| up to 355°C. | 78.5 | up to 355°C. | 68.3 |
| residue | 21.0 | residue | 31.1 |

In Table IV comparison data are presented on the reduction of corrosion and crystals for an uncorrected creosote, a corrected creosote and a hydrogenated creosote from batch and continuous operations. The hydrogenated creosotes include a hydrogenated A.W.-P.A. grade I creosote, a hydrogenated uncorrected creosote, and a hydrogenated uncorrected creosote that was adjusted to A.W.P.A. grade I after hydrogenation.

The corrosion rates were determined using a static corrosion test. This test consists of immersing 1 × 2 × 0.58 inch carbon steel plates in a pentacreosote mixture and adding water and wood chips to simulate treatment. The mixture was held at 101°–102°C. Weight changes were determined at 2-3 day intervals. The corrosion rate was calulated in terms of mils/year.

The reduction of crystals in the hydrogenated creosote was measured by the limpid point procedure and the crystal content procedure. A limpid point is the temperature at which crystals disappear in a creosote that has been subjected twice to heating and cooling. The crystal content procedure involves dissolving creosote in hexane at a constant temperature of 25°C. Then, the hexane-creosote mixture is filtered in a vacuum and the remaining crystals are weighed and their percent by weight of creosote is calculated.

sote to A.W.P.A. Grade I material first and then hydrogenating to insure the lowest possible corrosion rates.

Table IV also shows that hydrogenation of both A.W.P.A. Grade I creosote and uncorrected creosote lowers the limpid point and crystal content significantly. In particular, there is a marked decrease in crystal content (hexane insolubles) for both hydrogenated products. The actual improvement in limpid point is more difficult to interpret since it is essentially a "cloud" point. From Table IV is should be evident that crystal content at 25°C. is a more accurate measure of the degree of hydrogenation than limpid point. Crystal content appears to be one of the few physical properties that correlates directly with the $I_A$ value for

TABLE IV

| | Grade I Creosote | Mildly Hydrogenated Grade I Creosote | Uncor. Creosote | Mildly Hydrogenated Uncor. Creosote | Mildly Hydrogenated Uncor. Cr. Adjusted to Grade I | Uncor. Creosote |
|---|---|---|---|---|---|---|
| $I_A$ | 1.72 | 1.09 | 2.61 | 1.51 | 1.34 | (2.78) |
| Sp.Gravity at 38/15.5°C. | 1.086 | 1.068 | 1.118 | 1.102 | 1.076 | 1.136 |
| Water, % by vol. | Trace | 0.2 | Trace | Trace | Trace | Trace |
| Distillation, AWPA | | | | | | |
| To 210°C. | 0.8 | 2.1 | 0.0 | 0.0 | 1.8 | 0.0 |
| 235 | 4.6 | 6.7 | 0.0 | 0.2 | 5.9 | 0.0 |
| 270 | 22.9 | 24.5 | 4.7 | 4.7 | 21.8 | 0.1 |
| 315 | 53.0 | 56.2 | 27.7 | 32.1 | 51.6 | 12.4 |
| 355 | 78.5 | 80.0 | 68.3 | 71.1 | 78.249.1 | 52.8 |
| Residue | 21.0 | 19.3 | 31.1 | 28.5 | 21.3 | 50.8 |
| Limpid Point, °C. | 53 | 41 | 70 | 46 | 37 | 68.5 |
| Crystals, % (by wt.) at 25°C. | 3.19 | 0.31 | 7.43 | 0.65 | 0.02 | 9.9 |
| Corrosion, mils/yr. (approx. 210°F.) | | | | | | |
| No Penta Days 0–2 | 0.4 | 0.1(+) | 4.1 | 0.1(+) | 0.2 | — |
| 2–5 | 7.0 | 0.1(+) | 3.9 | 0.3(+) | 0.6 | — |
| 5–8 | 8.2 | 0.2 | 3.0 | 0.3 | 0.6 | — |
| With 2% Penta Days 0–2 | 61 | 0.2 | 53 | 13 | 30 | 30 |
| 2–4 | 63 | 7 | 52 | 9 | 37 | 33 |
| 4–7 | 64 | 16 | 34 | 11 | 48 | 34 |
| 7–9 | 68 | 19 | 23 | 14 | 39 | — |
| 9–12 | 62 | 23 | 16 | 14 | 38 | 16 |

| | Periodic Samples From a Continuous Run | | | | |
|---|---|---|---|---|---|
| | 35 | 25 | 42 | 16 | 9 |
| $I_A$ | (1.78) | (1.44) | (1.17) | (0.80) | (0.57) |
| Sp.Gravity at 38/15.5°C. | 1.123 | 1.119 | 1.114 | 1.104 | 1.098 |
| Water, % by vol. | Trace | Trace | Trace | Trace | Trace |
| Distillation, AWPA | | | | | |
| To 210°C. | 0.0 | 0.0 | 0.0 | 0.0 | 0.0 |
| 235 | 0.0 | 0.0 | 0.0 | 0.0 | 0.0 |
| 270 | 0.5 | 0.1 | 1.6 | 1.4 | 2.1 |
| 315 | 16.4 | 16.9 | 19.9 | 19.2 | 21.0 |
| 355 | 53.3 | 55.0 | 57.8 | 59.2 | |
| Residue | 47.1 | 46.3 | 44.5 | 41.4 | 39.4 |
| Limpid Point, °C. | 41.5 | 41.5 | 39.5 | 44 | 42 |
| Crystals, % (by wt.) at 25°C. | 1.1 | 0.36 | 0.03 | 0.03 | 0.02 |
| Corrosion, mils/yr. (approx. 210°F.) | | | | | |
| No Penta Days 0–2 | — | — | — | — | — |
| 2–5 | — | — | — | — | — |
| 5–8 | — | — | — | — | — |
| With 2% Penta Days 0–2 | 15 | 13 | 13 | — | 1 |
| 2–4 | 5 | 12 | 9 | 16 | 5 |
| 4–7 | 15 | 18 | 14 | 13 | 7 |
| 7–9 | 14 | 13 | 14 | 16 | 10 |
| 9–12 | 13 | 10 | 18 | 14 | 12 |

As Table IV shows, hydrogenation of A.W.P.A. Grade I and uncorrected creosote greatly reduces the corrosion rate of both products. However, when the hydrogenated uncorrected creosote was adjusted to A.W.P.A. Grade I specifications, i.e., PI-65, the corrosion rate nearly tripled. The increased corrosion rate was caused primarily by adding untreated naphthalene still residue to correct the distillation range. This illustrates the importance of adjusting uncorrected creodifferent batches of uncorrected creosote.

Samples of hydrogenated and unhydrogenated creosotes from both the batch and continuous operation were subjected to soil block assay for determination of preservative value. The soil block assay measure of preservative value indicated the preservative value of the creosotes from the most potent to the least potent was: unhydrogenated uncorrected creosote, hydrogenated uncorrected creosote, A.W.P.A. Grade No. I hydrogenated creosote and A.W.P.A. Grade No. I unhydrogenated creosote.

Agar plate tests on the hydrogenated creosote from the batch operation and the continuous operation indicated no loss in toxicity. A series of agar plates with three concentrations of each creosote oil preparation was exposed for a 28-day period to three species of wood-destroying fungi. One of the fungi, Lentinus lepideus, is known to be creosote tolerant. At the end of the 28-day exposure period, the growth of the organism was measured and recorded in centimeters. A growth of 9 cm. represents a total surface coverage of the agar plate. The results shown in Table V represent the average growth observed on three plates of each creosote-agar mixture.

Table V

Growth on Agar-Creosote Oil Mixtures After 28 Days Exposure (Continuous Run Samples)

| Organism | Conc. of Creosote Oil in Agar by Wt. | Regular Grade I Creosote | Hydrogenated Grade I Creosote | Uncorrected Creosote | Hydrogenated Uncorrected Creosote | Hydrogenated Uncorrected Creosote (Adjusted) |
|---|---|---|---|---|---|---|
| Lenzites | 0.1% | 0 | 0 | 0 | 0 | 0 |
| trabea | 0.01% | 5.5 | 6.0 | 4.0 | 4.5 | 5.5 |
| (M.A.-617) | 0.001% | 9.0 | 9.0 | 9.0 | 9.0 | 9.0 |
| Lentinus | 0.1% | 5.5 | 6.0 | 6.0 | 6.0 | 6.0 |
| lepideus | 0.01% | 9.0 | 9.0 | 9.0 | 9.0 | 9.0 |
| (M.A.-534) | 0.001% | 9.0 | 9.0 | 9.0 | 9.0 | 9.0 |
| Poria | 0.1% | 1.5 | 1.5 | 2.0 | 1.5 | 1.5 |
| monticola | 0.01% | 5.5 | 6.5 | 5.0 | 6.0 | 6.5 |
| (M.A.-698) | 0.001% | 9.0 | 9.0 | 9.0 | 9.0 | 9.0 |

Growth on Agar-Creosote Oil Mixtures After 28 Days Exposure (Batch Run Samples)

| Organism | Creosote Oil | Hydrogenated Creosote | Hydrogenated Creosote Run No. 3 | Hydrogenated Creosote Run No. 1 | Double Distilled Hydrogenated Creosote Run No. 2 |
|---|---|---|---|---|---|
| Lenzites | 0 | 0 | 0 | 0 | 0 |
| trabea | 6.0 | 5.5 | 6.0 | 5.5 | 5.5 |
| (M.A.-617) | 9.0 | 9.0 | 9.0 | 9.0 | 9.0 |
| Lentinus | 7.0 | 7.5 | 7.0 | 7.0 | 5.5 |
| lepideus | 9.0 | 9.0 | 9.0 | 9.0 | 9.0 |
| (M.A.-534) | 9.0 | 9.0 | 9.0 | 9.0 | 9.0 |
| Poria | 2.5 | 2.5 | 2.0 | 1.5 | 1.5 |
| monticola | 7.0 | 7.5 | 7.5 | 7.0 | 7.0 |
| (M.A.-698) | 9.0 | 9.0 | 9.0 | 9.0 | 9.0 |

The results of this agar plate test show that the characteristic toxic properties of coal tar creosote have not been significantly altered in the various combinations of hydrogenated creosote.

The tables and discussion above indicate that a creosote that is mildly hydrogenated, i.e., a 10–62% reduction in $I_A$, may be produced in either a batch or continuous operation. This mildly hydrogenated creosote has a reduced crystal content from a conventional creosote and would require a smaller quantity of correction oil to keep the crystals in the solution of hydrogenated creosote. Also, the mildly hydrogenated creosote has a lighter color than a conventional creosote. Also, this mildly hydrogenated creosote reduces the corrosion to metal of a pentachlorophenol in creosote mixture when it is used as the creosote to which the pentachlorophenol is added. The mildly hydrogenated creosote has these beneficial qualities while retaining the toxicity of a conventional coal tar creosote.

According to the provisions of the patent statutes, the principle, preferred construction and mode of operation of the invention have been explained and what is considered to represent its best embodiment has been illustrated and described. However, it should be understood that within the scope of the appended claims, the invention may be practiced otherwise than as specifically illustrated and described.

I claim:

1. A process for producing an improved creosote wood preservative having a reduced tendency to form crystals and a lighter color than a conventional coal tar creosote, comprising:

subjecting a conventional coal tar creosote to a mild hydrogenation to reduce the aromaticity index by 10–62%, whereby the improved creosote wood preservative is produced.

2. A process according to claim 1 which includes adding a correction oil to the conventional coal tar creosote.

3. A process according to claim 1 which includes adding a non-corrosive correction oil to the improved creosote wood preservative.

4. A process according to claim 1 wherein the mild hydrogenation is conducted with hydrogen in the presence of a sulfur resistant hydrogenation catalyst at a temperature in the range of 250-450°C. at a pressure in the range of 500-1500 psig and at a reaction time sufficient for a 10-62% reduction in the aromaticity index of the conventional coal tar creosote.

5. A process according to claim 4 wherein the reaction time is in the range of 0.5–6.0 hours.

6. A process according to claim 4 wherein the reaction time as expressed in WHSV is in the range of 1.0 to 5.0 pounds of creosote per hour per pound of catalyst.

7. A process according to claim 4 wherein the sulfur resistant hydrogentation catalyst is selected from the group consisting of tungsten sulfide, cobalt sulfide or molybdenum sulfide or a mixture of two or more of these compounds.

8. A process according to claim 7 wherein the sulfur resistant hydrogenation catalyst is supported on a carbonaceous or oxide support.

9. A process for producing an improved pentachlorophenol in creosote wood preservative having a reduced corrosivity to metals, comprising:

subjecting a conventional coal tar creosote to mild hydrogenation to reduce the aromaticity index 10-62% to produce an improved creosote;

and adding pentachlorophenol to the improved creosote.

10. A process according to claim 9 which includes adding a correction oil to the conventional coal tar creosote before mild hydrogenation.

11. A process according to claim 9 wherein a minimum of 2% pentachlorophenol is dissolved in the improved creosote.

12. A process according to claim 9 which includes adding a non-corrosive correction oil to the improved creosote before the pentachlorophenol is added to the improved creosote.

13. A process according to claim 9 wherein the mild hydrogenation is conducted with hydrogen in the presence of a sulfur resistant hydrogenation catalyst at a temperature in the range of 250°-450°C. and at a pressure in the range of 500–1500 psig and at a reaction time sufficient for the 10–62% reduction in the aromaticity index of the conventional coal tar creosote.

14. A process according to claim 13 wherein the sulfur resistant hydrogenation catalyst is selected from the group consisting of tungsten sulfide, cobalt sulfide or molybdenum sulfide or a mixture of two or more of these compounds.

15. A process according to claim 13 wherein the sulfur resistant hydrogenation catalyst is supported on a carbonaceous or oxide support.

* * * * *